US010434531B2

(12) United States Patent
Goettke

(10) Patent No.: US 10,434,531 B2
(45) Date of Patent: Oct. 8, 2019

(54) FINGER SPRAY PUMP

(71) Applicant: RPC Bramlage GmbH, Lohne (DE)

(72) Inventor: Sabine Goettke, Lohne (DE)

(73) Assignee: RPC Bramlage GmbH, Lohne (DE)

( * ) Notice: Subject to any disclaimer, the term of this patent is extended or adjusted under 35 U.S.C. 154(b) by 0 days.

(21) Appl. No.: 15/504,752

(22) PCT Filed: Aug. 20, 2015

(86) PCT No.: PCT/EP2015/069121
§ 371 (c)(1),
(2) Date: Feb. 17, 2017

(87) PCT Pub. No.: WO2016/030266
PCT Pub. Date: Mar. 3, 2016

(65) Prior Publication Data

US 2017/0266679 A1 Sep. 21, 2017

(30) Foreign Application Priority Data

Aug. 26, 2014 (DE) ..... 20 2014 103 981 U

(51) Int. Cl.
*B05B 11/00* (2006.01)
*B65D 43/02* (2006.01)

(52) U.S. Cl.
CPC ..... *B05B 11/3025* (2013.01); *B05B 11/3074* (2013.01); *B65D 43/0214* (2013.01); *B05B 11/3047* (2013.01)

(58) Field of Classification Search
CPC ..... B05B 11/3025; B05B 11/3074; B05B 11/3047; B65D 43/0214
See application file for complete search history.

(56) References Cited

U.S. PATENT DOCUMENTS 5,482,188 A * 1/1996 Lina ..... B05B 11/3025 222/321.2
2005/0023302 A1* 2/2005 Cater ..... B05B 11/3025 222/402.1

(Continued)

FOREIGN PATENT DOCUMENTS

| | | | |
|---|---|---|---|
| EP | 1 389 491 | A1 | 2/2004 |
| EP | 1 938 903 | A2 | 7/2008 |
| WO | 03/104107 | A1 | 12/2003 |

OTHER PUBLICATIONS

International Search Report of PCT/EP2015/069121, dated Apr. 22, 2016.

*Primary Examiner* — Donnell A Long
(74) *Attorney, Agent, or Firm* — Collard & Roe, P.C.

(57) ABSTRACT

A finger spray pump for spraying a medium, which includes a finger-actuated pump head, an outlet nozzle and a pump chamber which includes an inlet valve and a pump piston which can be moved by moving the pump head. The medium passes through a medium path between the pump chamber and outlet nozzle, additionally, the pump piston forms, in cooperation with a piston rod, an outlet valve and the pump piston can be moved with respect to the piston rod counter to the force of a first spring for actuating the outlet valve, the piston rod can be moved counter to the force of a second spring. Additionally, both springs are arranged outside of the medium path. In order to obtain a compact design, both springs are arranged at a distance from each other, axially independent from the pump position.

9 Claims, 10 Drawing Sheets

(56) References Cited

U.S. PATENT DOCUMENTS

| | | | | |
|---|---|---|---|---|
| 2006/0169724 | A1 | 8/2006 | Beranger et al. | |
| 2008/0164344 | A1 | 7/2008 | Lompech et al. | |
| 2012/0267399 | A1* | 10/2012 | Moretti | B05B 11/3008 222/321.2 |
| 2012/0325862 | A1* | 12/2012 | Kuwahara | B05B 11/3023 222/321.9 |
| 2013/0306757 | A1* | 11/2013 | Parmentier | B05B 1/3436 239/404 |
| 2014/0217124 | A1 | 8/2014 | Kim et al. | |

* cited by examiner

FINGER SPRAY PUMP

CROSS REFERENCE TO RELATED APPLICATIONS

This application is the National Stage of PCT/EP2015/069121 filed on Aug. 20, 2015, which claims priority under 35 U.S.C. § 119 of German Application No. 20 2014 103 981.3 filed on Aug. 26, 2014, the disclosures of which are incorporated by reference. The international application under PCT article 21(2) was not published in English.

The invention relates in first instance to a finger spray pump for spraying a medium, comprising a finger-actuatable pump head, an outlet nozzle and a pump chamber having an inlet valve and a pump piston that can be moved by moving the pump head, wherein the medium passes through a medium path between the pump chamber and the outlet nozzle, wherein, furthermore, the pump piston in cooperation with a piston rod forms an outlet valve and the pump piston can be moved relative to the piston rod against the force of a first spring for actuating the outlet valve, wherein the piston rod is movable against the force of a second spring and wherein, furthermore, both springs are disposed outside of the medium path.

Finger spray pumps of the kind in question are well known. They serve, for example, for spraying a liquid medium. The outlet valve preferably opens only upon reaching a predetermined pressure within the pump chamber as a result of a corresponding finger action acting on the pump head, whereupon the medium can exit via the medium path and the outlet nozzle. In doing so, the pump head can be further displaced, in particular lowered, while overcoming the force of one of the springs for expelling the medium situated in the pump chamber by means of pressing.

With regard to the known prior art it is an object of the invention to provide a finger spray pump of the kind in question in a compact design.

A possible solution to the object is provided according to a first inventive concept in the case of a finger spray pump for which it is aimed that both springs are axially spaced apart from one another independent of the pump position. Hereby, a compact and particularly slim design of the finger spray pump can be achieved. The two springs are preferably noted nested. Rather, an axially lower end of an upper spring preferably extends above an axially upper end of a lower spring.

Here, the first spring can have a greater spring constant than the second spring. In an alternative configuration, the second spring has a greater constant than the first spring. Accordingly, one spring is set to be stronger than the other one, with both springs preferably having a configuration as compression springs, in particular as cylindrical compression springs.

In the actuated and/or not actuated position, the pump piston preferably protrudes an end region of the piston rod, which end region provides the outlet valve. This end region of the piston rod forms a piston bottom which is axially movable relative to the pump piston and which, when being acted on via the pump head, can be displaced against the force of one of the two springs in the axial direction relative to pump piston within the pump piston. A corresponding displacement of the piston bottom results in opening the outlet valve and expelling the medium situated in the pump chamber via the medium path to the outlet nozzle. Preferably, the axial mobility of the piston bottom secured with the piston rod is limited to the axial length of extent of the chamber encompassed by the pump piston.

The piston rod preferably has a central axial opening for forming the medium path. Accordingly, the piston rod is preferably substantially designed in the form of a tube which preferably, when facing the end of the piston bottom and in the lowered position of the piston bottom and thus in the open position of the outlet valve, communicates with the pump chamber via radial openings.

The invention further relates to a finger spray pump for spraying a medium, comprising a pump head, an outlet nozzle and a pump chamber which has an inlet valve and a pump piston, wherein the medium passes through a medium path between the pump chamber and the outlet nozzle, wherein furthermore the pump, in cooperation with a piston rod, forms an outlet valve and the pump piston runs in a pump cylinder.

In order to configure such a finger spray pump in an advantageous manner with regard to manufacture, the invention proposes that a latching part is connected to the pump cylinder and that the latching part is formed for supporting a pump head spring that supports the pump head relative to the pump cylinder.

Thus, by exchanging the latching part with another latching part that has, for example, a raised supporting bottom for the pump head spring, the preload of the pump head spring can be varied. Also, through a suitable configuration of the latching part in the receiving region for the pump head spring, an adaption with respect to the diameter of the spring wire, for example by designing the pump head spring as a cylindrical metal spring, can be made.

Furthermore, while retaining the further components of the finger spray pump, such as, for example, the pump head, outlet nozzle, pump chamber and pump piston as well as pump cylinder, an adaption to various parameters can be achieved just by exchanging the latching part.

After assembly, the latching part is secured to the pump cylinder such that it preferably cannot be removed without a tool and, moreover, preferably cannot be removed in a non-destructive manner.

The pump head spring is preferably the second spring, against the force of which the piston rod can be moved.

More preferably, a piston spring (first spring) is provided between the piston rod and the pump piston. In a preferred configuration, this piston spring is at least partially accommodated in the latching part. Thus, in a preferred configuration, a portion of the latching part extends such that it, at least in a pump position, encompasses the piston spring in a shell-like manner.

Also, the piston spring and the pump head spring can be supported on the latching part. Here, the piston spring and the pump head spring are preferably arranged axially one behind the other, i.e. one behind the other as viewed in the displacement direction of the pump head. In a preferred configuration, this arrangement of the springs also applies if only the latching part forms a support for the pump head spring.

The latching part preferably forms a collar which extends towards the pump head and which leaves a circumferential space to the piston rod, in which circumferential space the pump head spring is accommodated at least with a portion of its axial length of extent. For example, by changing the internal diameter of the circumferential space and with a suitable arrangement of a latching part formed in such a manner, a pump head spring having a changed spring constant can be used.

The latching part advantageously also serves directly or indirectly for fixing the finger spray pump to a container.

Thus, by arranging a suitably formed latching part, fixing the finger spray pump to differently configured containers can be achieved.

Thus, in one configuration, the finger spray pump is formed for a crimp connection with a container. Such a crimp connection preferably cannot be detached in a non-destructive manner.

A crimp sleeve, in particular a metallic crimp sleeve, can be provided, which encompasses the latching part and the pump cylinder at the same time in the region of at least the cooperation of the latching part and the pump cylinder. Here, the latching part is preferably designed for fixing the crimp sleeve in the region of the finger spray pump, in particular by engaging around the latching part, and more preferably by engaging the latter from below in a waist-like manner.

Also, the finger spray pump can be formed for a snap-on connection with the container, wherein elements for engaging underneath a container neck are formed on the latching part which, at the same time, is formed for engaging over the container neck.

The elements are preferably formed from the same material as and integrally with the latching part. Thus, in a preferred configuration, the latching part is formed so as to directly fix the finger spray pump to the container, in particular to the container neck.

The latching part can be encompassed by a sleeve part, in any case in the region of its portion associated with the container neck. This sleeve part, as well as the further substantial components of the finger spray pump, optionally with the exception of the springs, can be formed as a plastic part, in particular injection-molded plastic part. In this regard, a metallic sleeve part is preferred.

Moreover, the latching part can also be formed with a screw cap for forming a screw connection with the container neck. Such a screw cap too, is preferably molded from the same material as and integrally with the latching part, thus in particular as an injection-molded plastic part.

The invention is explained below with reference to the accompanying drawing which, however, merely illustrates exemplary embodiments. A part which is explained only in relation to one of the exemplary embodiments and which in a further exemplary embodiment, due to the peculiarity featured therein, is not replaced by another part, is therefore also described for this further exemplary embodiment in any case as a possible present part. In the drawing.

Figure 1:
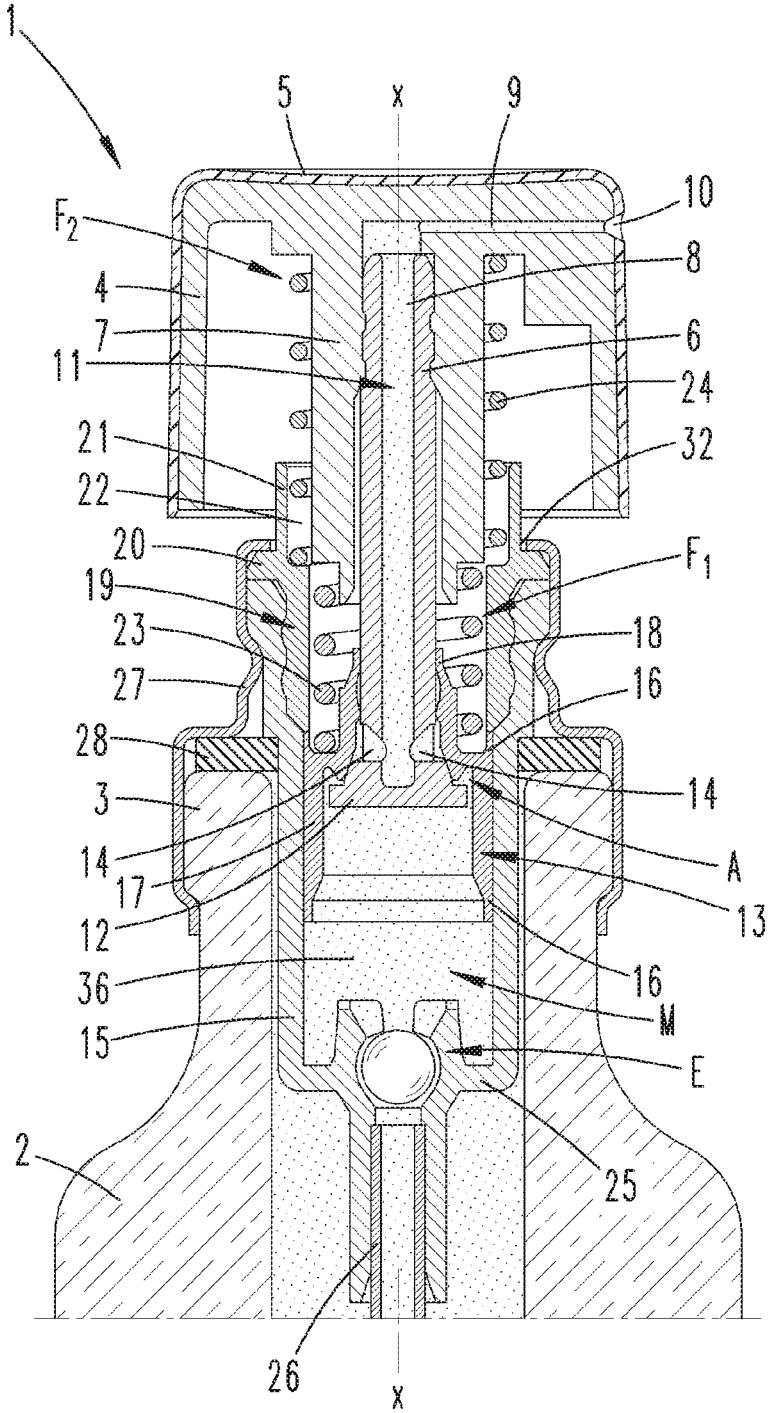
FIG. 1 shows in a longitudinal sectional view a finger spray pump of a first embodiment in crimp connection with a container, in regards to the non-actuated position of the finger spray pump.

Illustrated and described, in first instance with reference to FIG. 1, is a finger spray pump 1 for spraying a medium M, in particular a liquid medium.

The finger spray pump 1 is formed for arrangement on a container 2 which stores the medium M and has a container neck 3 to which the finger spray pump 1 is substantially fixed.

The finger spray pump 1 has a finger-actuatable pump head 4 with an actuation surface 5 which, in the illustrated exemplary embodiment, extends substantially transverse to a central body axis x of the finger spray pump 1, and also extends transverse to the body axis of the container 2 in the associated state.

Furthermore, the pump head 4 as a whole is configured in an approximately pot-like manner and has a downward-facing pot opening.

A piston rod 6, which is formed rotationally symmetric to the body axis x and which can extend beyond the plane of the pot opening is centrally molded or secured at the lower side of the actuation surface 5.

Figure 2:
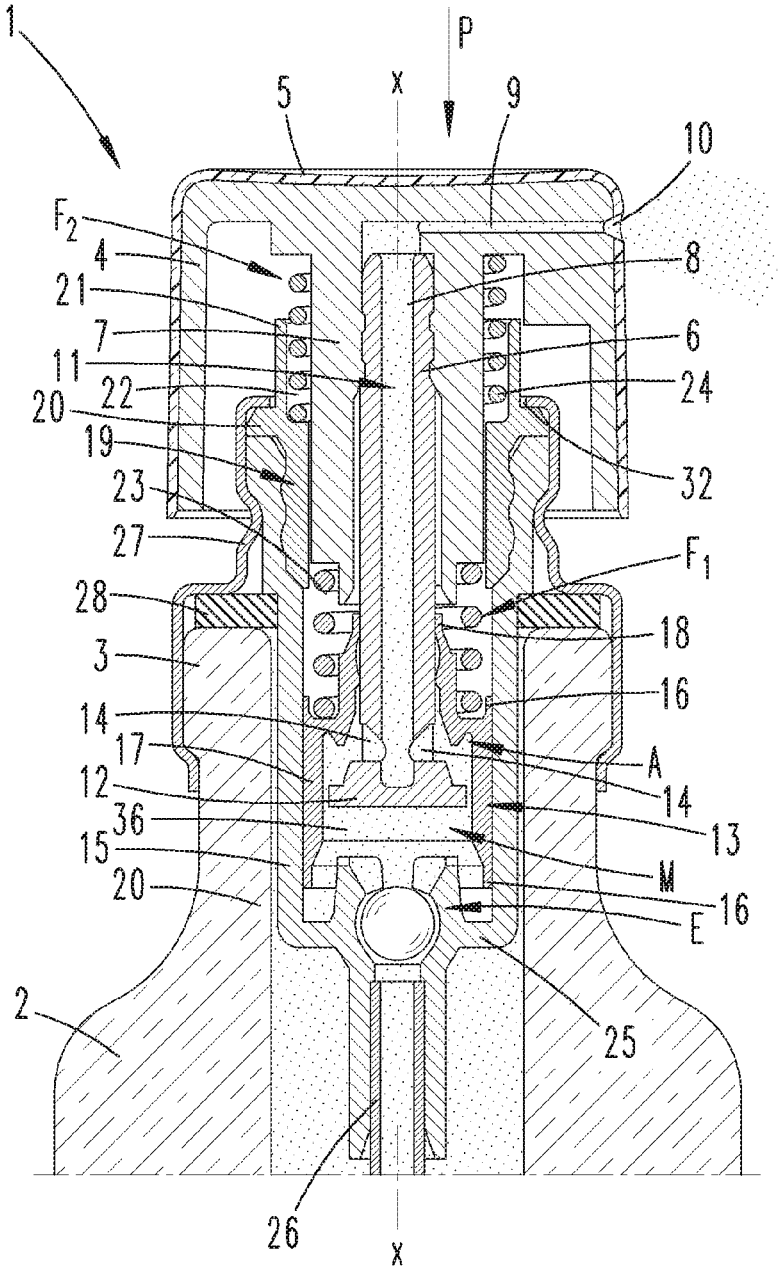
FIG. 2 shows an illustration according to FIG. 1, but in regards to an intermediate position in the course of the actuation of the finger spray pump.
Figure 3:
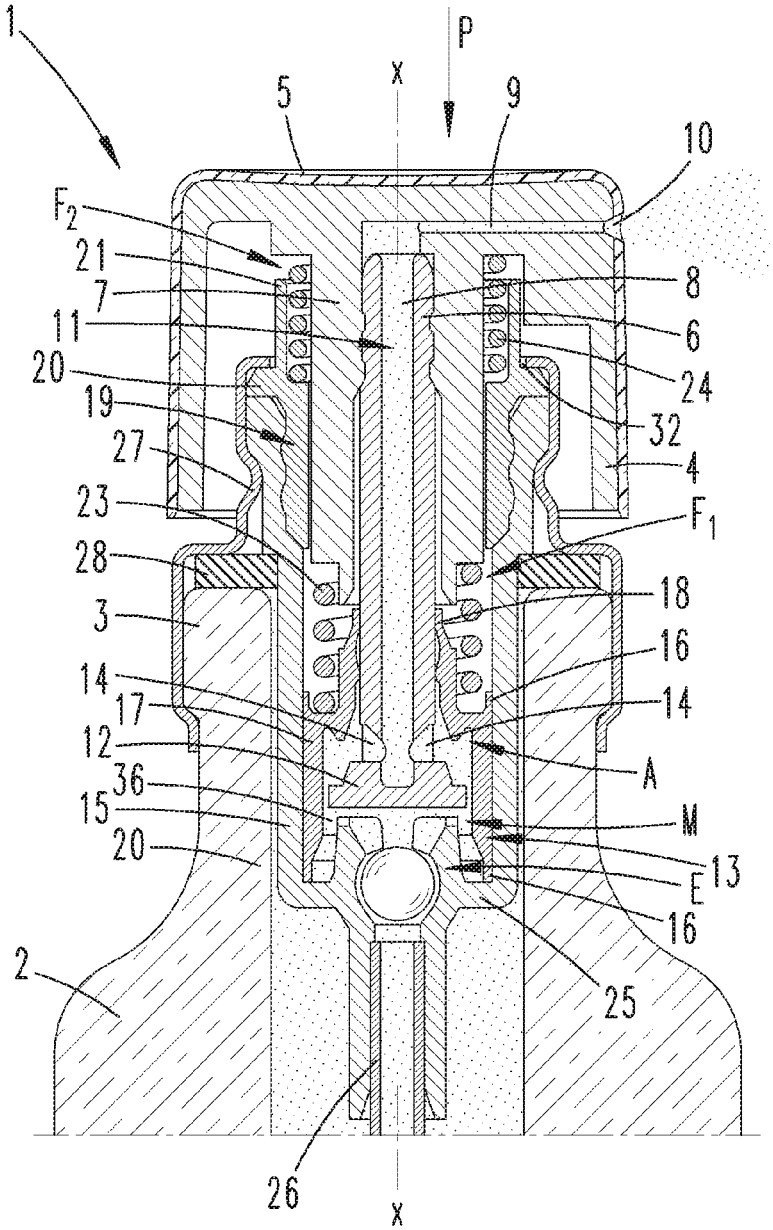
FIG. 3 shows an illustration subsequent to FIG. 2 in regards to the pump position.

In the exemplary embodiment illustrated in the FIGS. 1 to 3, the piston rod 6 is latched in a tube-section-like rod holder 7 which preferably is formed integrally with and from the same material as the pump head 4. The piston rod 6 is encompassed by the rod holder 7 over a sub-portion of the axial length of the piston rod 6.

The piston rod 6 has a central axial opening 8. The latter extends preferably over the entire axial length of extent of the piston rod 6 and ends at the lower side of the actuation surface 5 in radial channel 9 at the pump head. The radial channel ends in an outlet nozzle 10.

The radial channel 9 and the axial opening 8 as a whole substantially form a medium path 11.

The piston rod's 6 end facing away from the pump head 4 carries a plate-like end that widens radially with respect to the piston rod 6. The plate-like end forms a piston bottom 12 of a pump piston 13 that encompasses the piston bottom 12 and an end portion of the piston rod 6, which end portion faces the piston bottom 12.

Directly above the piston bottom 12, the piston rod 6 is provided with radial openings 14 for connecting the axial opening 8 with the space surrounding the piston rod 6 radially outside above the piston bottom 12.

The pump piston 13 is arranged in a pump cylinder 15 so as to be movable along the body axis x. The pump piston 13 has a circumferential piston wall 17 which interacts with the inner cylinder wall via sealing lips 16.

The piston wall 17 transitions into a portion of decreased diameter for sealingly interacting with the exposed outer surface of the piston rod 6. In this region too, at least one circumferential sealing lip 18 is provided.

On the inside, associated with the step-like transition of the piston wall 17 into the region of decreased diameter, the piston wall 17 forms a seal seat for the piston bottom 12.

The pump cylinder 15 opens radially upwards towards the pump head 4, wherein the respective end of the pump cylinder 15 radially encompasses the piston rod 6 and the rod holder 7 at least in the pressed-down actuation position of the pump head 4.

In the non-actuated pump head position according to FIG. 1, an upward facing peripheral edge of the pump cylinder 15 extends approximately at the height of an axially downward oriented front end peripheral edge of the rod holder 7, more preferably at an axial spacing to the downward oriented peripheral edge of the opening of the pump head 4.

The axially upward oriented end region of the pump cylinder is formed radially inside for latched fixation of a sleeve-like latching part 19. The latching part 19 has a circular cross-section that is substantially adapted to the inner wall of the pump cylinder 15 and extends further radially inside the latching portion of the pump cylinder.

Moreover, the latching part 19 is supported on the facing front end peripheral edge of the pump cylinder 15 via a radial collar 20.

Starting from this radial collar 20, a collar 21 extends which runs coaxial to the body axis x and which leaves a circumferential space 22 to the piston rod 6 and preferably also to the rod holder 7.

The pump piston 13 guided in the pump cylinder 15 is supported via a first spring $F_1$ or, respectively, a piston spring 23 against the piston rod 6, more preferably against the rod holder 7 holding the piston rod 6.

The piston spring 23 or, respectively, the first spring $F_1$ is preferably a cylindrical compression spring which is supported at one end on the pump piston 13 in the step-like offset region of the piston wall 17, and is supported at the other end on the end face of the rod holder 7 facing towards the pump piston 13. Here, the piston spring 23 or, respectively, the first spring $F_1$ encompasses the diameter-reduced region of piston wall 17, which is sealingly supported on the piston rod 6, as well as the piston rod's 6 free portion protruding beyond the rod holder 7.

Moreover, a second spring $F_2$ is provided as a pump head spring 24. The latter, while encompassing the rod holder 7 and thus the piston rod 6 in the fixation region, is supported at one end on the latching part 19 in the circumferential space 22 and, at the other end, it acts at the bottom side of the actuation surface 5 against the pump head 4. This pump head spring 24 or, respectively, second spring $F_2$ is a cylindrical compression spring as well.

Figure 4:
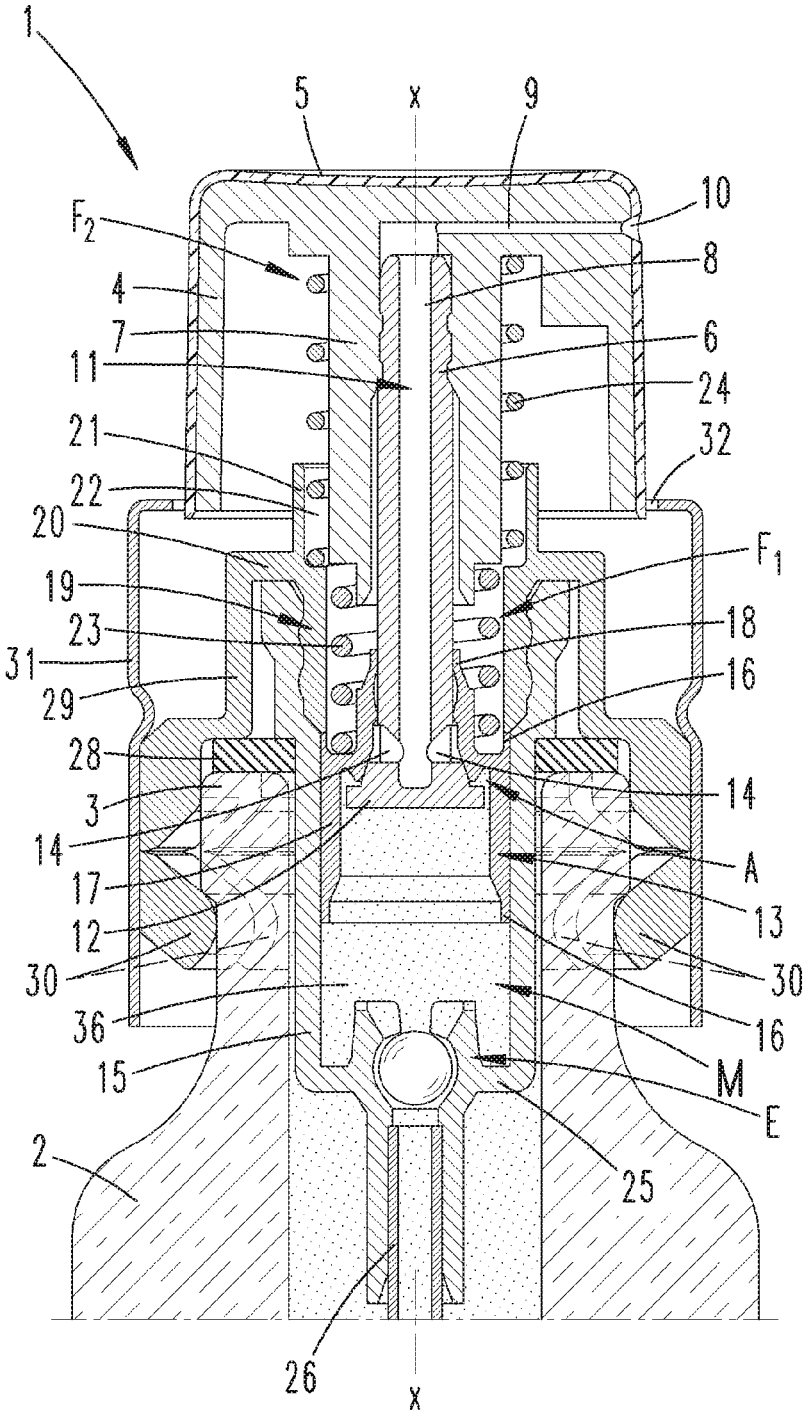
FIG. 4 shows an illustration according to FIG. 1, but for a configuration of the finger spray pump for a snap-on connection with the container.
Figure 5:
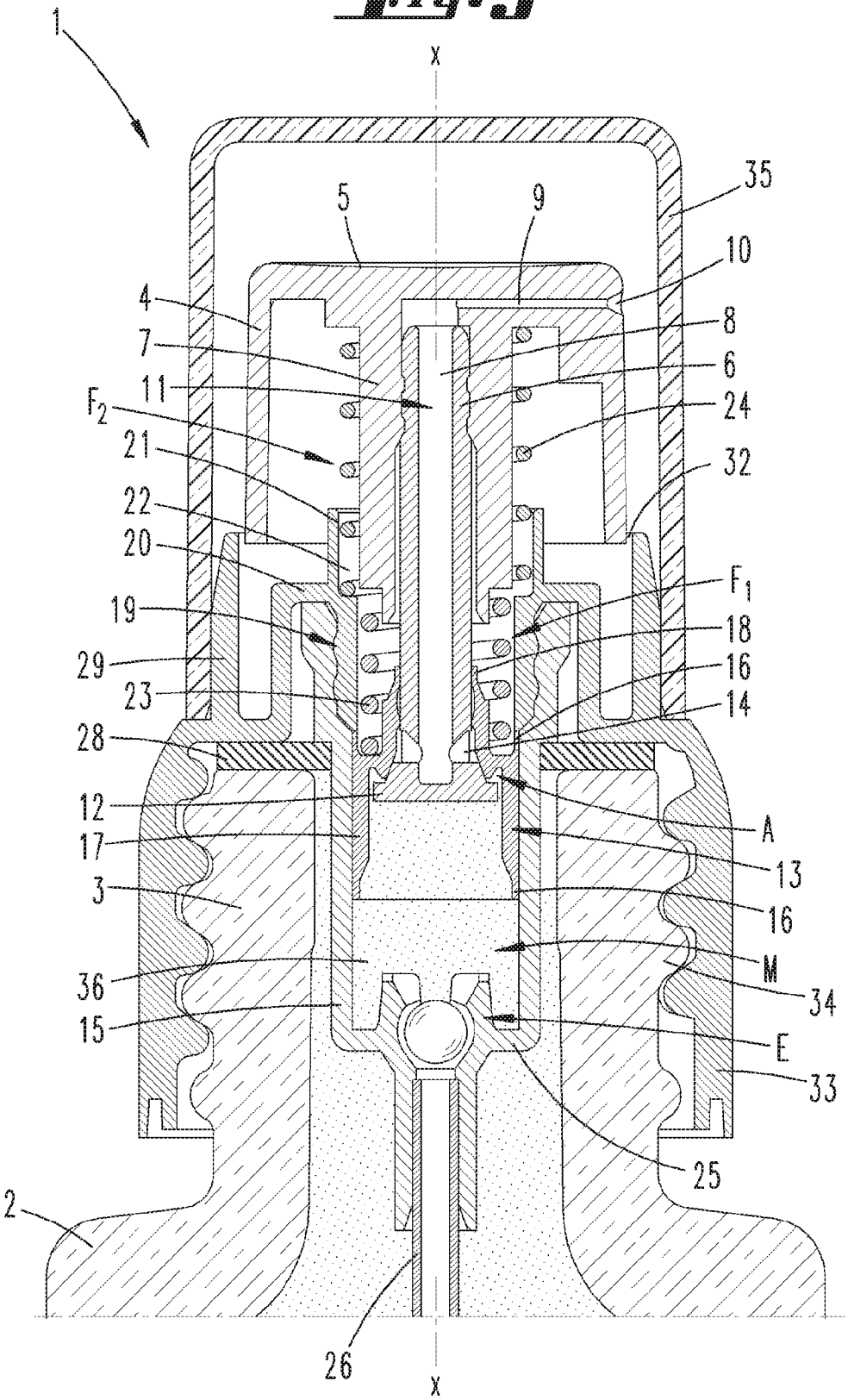
FIG. 5 shows a further illustration according to FIG. 1, with the finger spray pump configured for a screw connection with the container.

In the exemplary embodiment illustrated in the FIGS. 1 to 3 and furthermore also in the FIGS. 4 and 5, the spring constant of the first spring $F_1$, thus the piston spring 23, is selected to be greater than the spring constant of the second spring $F_2$ (pump head spring 24).

In cooperation with the seal seat of the piston wall 17, the piston bottom 12 forms an outlet valve A.

In the region of the pump cylinder bottom 25, an inlet valve E is formed, preferably in the form of a ball valve, at the lower side of which a connection for a suction tube is connected. The latter extends into the container interior.

In the FIGS. 1 to 3, a finger spray pump 1 of the first embodiment is formed for a crimp connection with the container 2. For this purpose, a crimp sleeve 27 is provided which encompasses the latching part 19 and the pump cylinder 15 at the same time, at least in the region of cooperation of the latching part and the latching region of the pump cylinder 15.

The crimp sleeve 27 encompasses the container neck 3, wherein supporting the finger spray pump 1 on the end face of the container neck 3 takes place via the crimp sleeve 27, preferably by interpositioning a sealing washer 28.

As an alternative, according to the illustration in FIG. 4, a finger spray pump 1 configured as described above can also be fixed to the container 2 via a snap-on connection. For this purpose, the radial collar 20 of the latching part 19 is widened in a cylinder portion 29 that runs coaxial to the body axis x and widens radially over one step. Support on the container neck 3 is provided in the region of the step with interposition of the sealing washer 28.

The radially widened region of the cylinder portion 29 carries inwardly oriented elements 30 for engaging beneath the container neck 3. Accordingly, this results in latching on the container neck 3.

The elements 30 are preferably made from the same material as and integrally with the latching part 19, for example as a result of manufacturing using the plastic injection molding method.

Further, the elements 30 are formed such that in the course of the assembly, the elements can run over the container neck 3 due to elastic deflection.

Furthermore, there is provided a sleeve part 31 which encompasses the latching part 10 radially on the outside over the axial extent thereof. The sleeve part rests against the outer wall of the cylinder portion 29 in the radially widened region thereof and is supported on the latching part 19 in the region of the step of the cylinder portion 29.

The sleeve part 31 forms a ceiling that is oriented transverse to the body axis x and has a central opening through which the pump head 4 can extend upon its actuation.

Also, according to the illustration in FIG. 5, a screw connection can be provided. For this purpose, the latching part 19 is radially widened to form a screw cap 33 for cooperating with an external thread 34 in the region of the container neck 3. In the screwed-on position, the screw cap 33 is supported on the end face of the container neck 3 with the sealing washer 28 positioned therebetween.

Furthermore, as illustrated in FIG. 4 by way of example, the pump head 4 can be covered in the non-use position by a cover cap 35.

For spraying the medium M, the pump head 4, as a result of the pressure acting on the actuation surface 5 thereof, is displaced downwards along the body axis x against the force of the pump head spring 24 or, respectively, the second spring $F_2$, relative to the stationary latching part 19 and the pump cylinder 15.

The piston spring 23, which is stronger with respect to the pump head spring 24, in first instance puts load on the pump piston 13 in the closed position of the outlet valve A in that the piston wall 17 is pushed to the piston bottom 12 into the sealing position.

Only upon reaching a pressure exceeding the spring force of the piston spring 23 in the pump chamber 36 provided below the pump piston 13 in the pump cylinder 15, the spring force of the piston spring 23 is overcome, which results in a relative displacement of the piston rod 6 with the piston bottom 12 with respect to the pump piston 13 (compare FIG. 2).

As a result of maintaining the pressure acting on the pump head 4 and the accompanying continuous downward-pressing thereof, the medium M is discharged via the open outlet valve A and medium path 11 which is now connected to the pump chamber 36. The medium M is sprayed out under pressure through the outlet nozzle 10 until the pump piston 13, which, in the opening state of the outlet valve A runs along driven by the piston spring 23, reaches the lowered position according to FIG. 3 which is defined by a limit stop.

In the exemplary embodiment illustrated, a displacement travel of the piston rod 6 with the piston bottom 12 relative to the pump piston 13 from 1 to 2 mm, more preferably approximately 1.5 mm is given. The total displacement travel of the pump piston 13 from the non-loaded position illustrated in FIG. 1 up to the end position limited by a stop according to FIG. 3 is, for example, 4 to 5 mm, preferably approximately 4.4 mm, so that a total stroke during spraying of approximately 5.5 to 6.5 mm, for example 5.9 mm is given.

Here, the pump chamber 36 is preferably designed such that with one spraying stroke, approximately 0.1 to 0.15 ml, for example 0.12 ml medium M is expelled.

After expelling the medium M and without pressure acting on the pump head 4, the system returns automatically to the initial position according to FIG. 1 as a result of a corresponding returning of the pump head 4 with its piston rod 6 and piston bottom 12 via the pump head spring 24 and of the pump piston 13 via the piston spring 23, wherein the returning via the stronger piston spring 23 runs ahead so as to prematurely close the outlet valve A.

In the course of the displacement of the pump piston 13 back into the initial position, medium M for refilling the pump chamber 36 is continuously fed through the inlet valve E, which opens here as a result of the suction effect, and through the suction tube 26.

Figure 6:
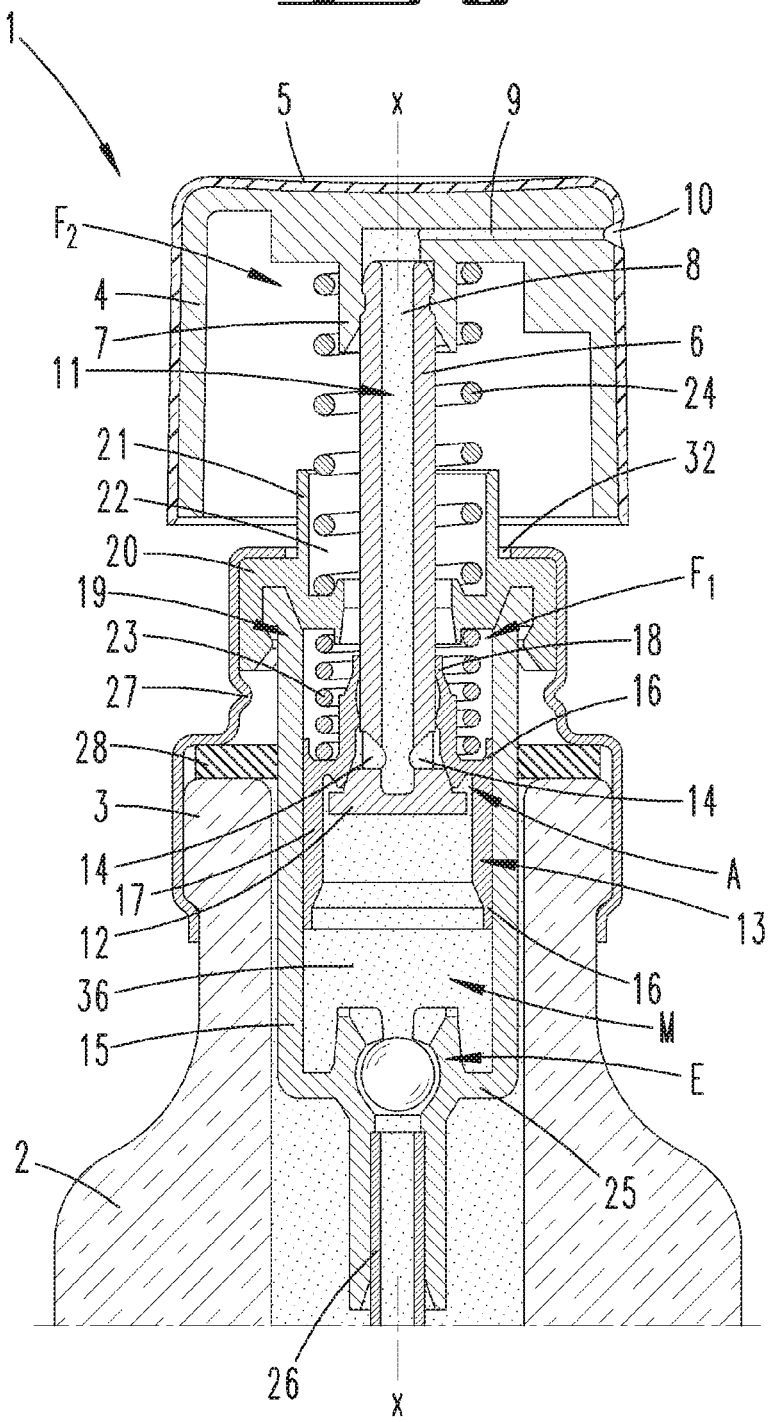
FIG. 6 shows an illustration according to FIG. 1, but in regards to a second embodiment of the finger spray pump.
Figure 7:
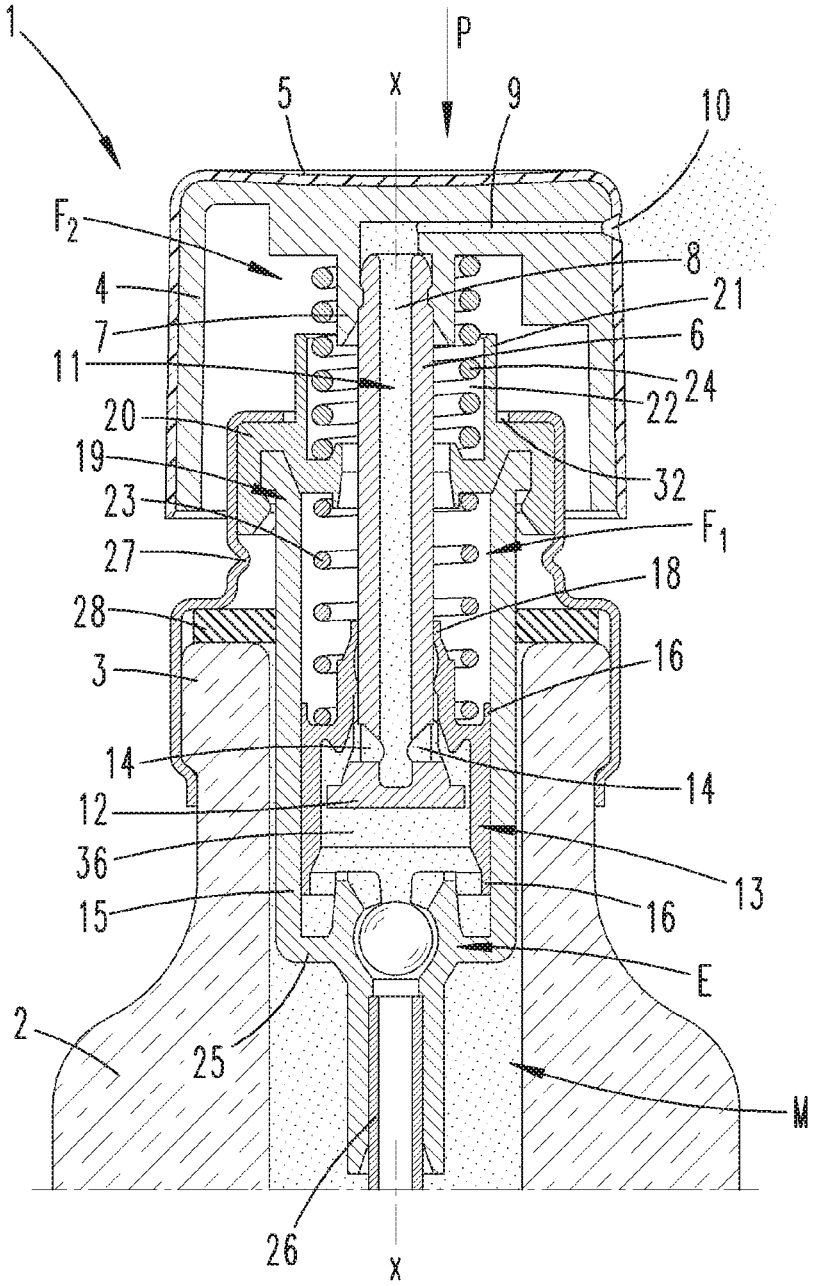
FIG. 7 shows an intermediate position in the course of the actuation of the finger spray pump.
Figure 8:
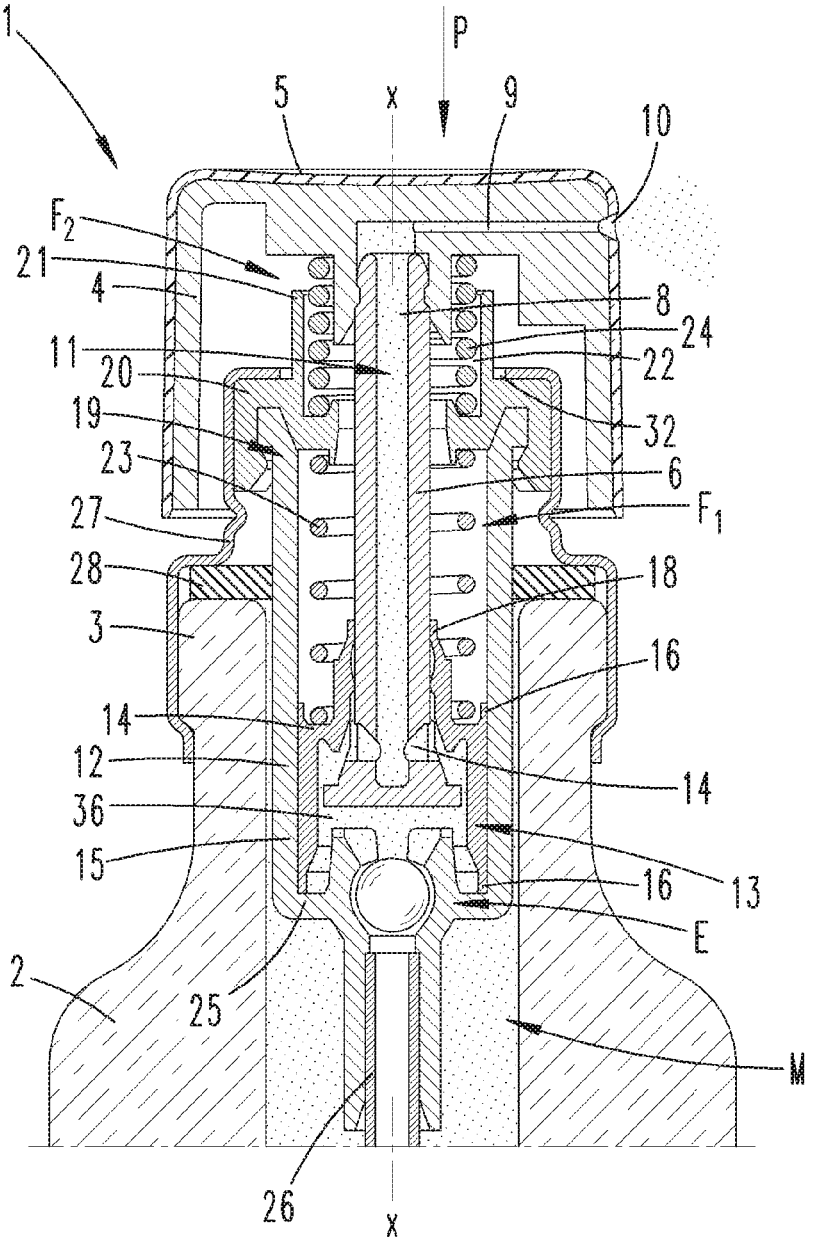
FIG. 8 shows an illustration subsequent to FIG. 7, in regards to the pump position.
Figure 9:
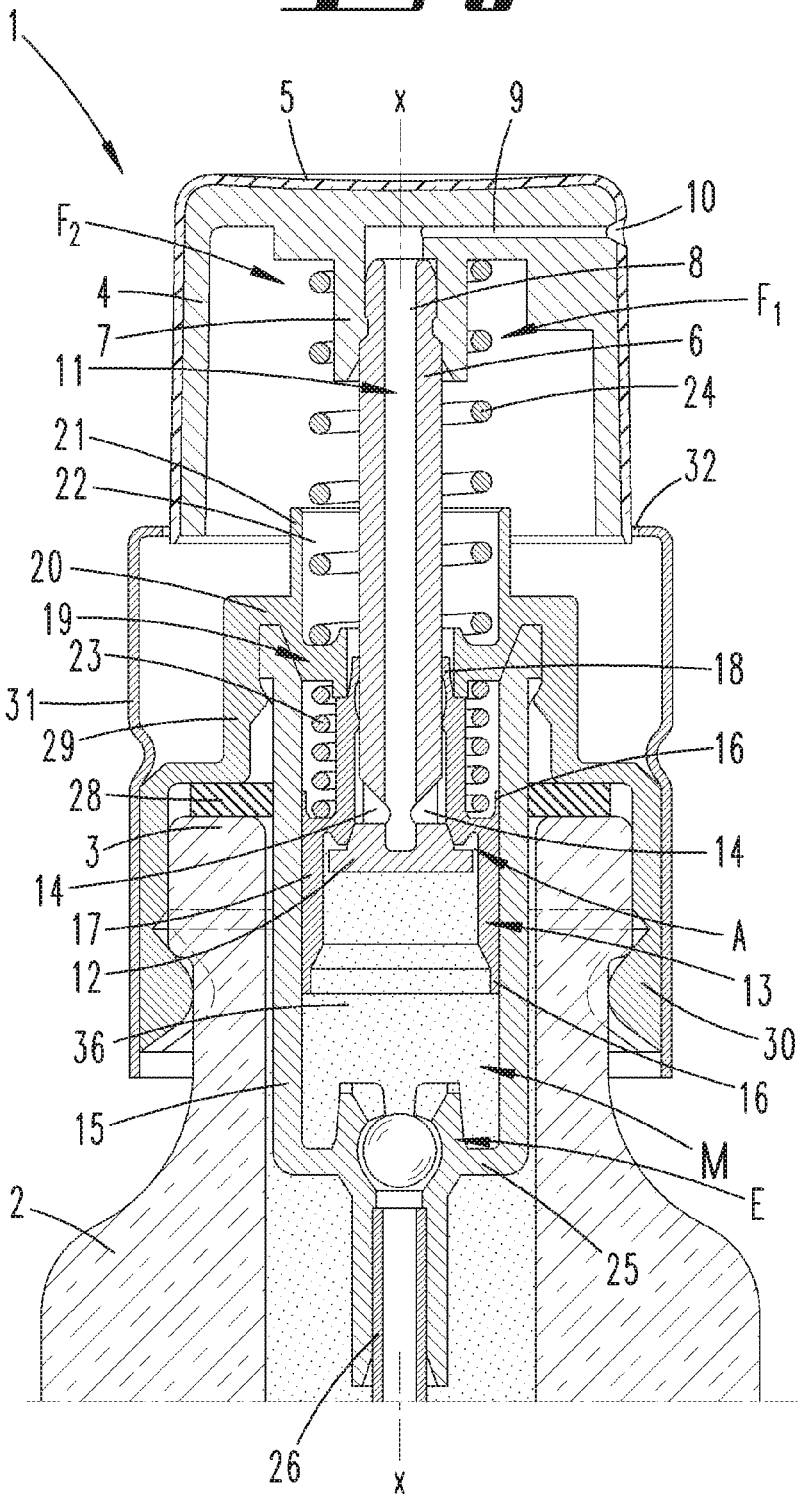
FIG. 9 shows an illustration according to FIG. 4, but in regards to the second embodiment.
Figure 10:
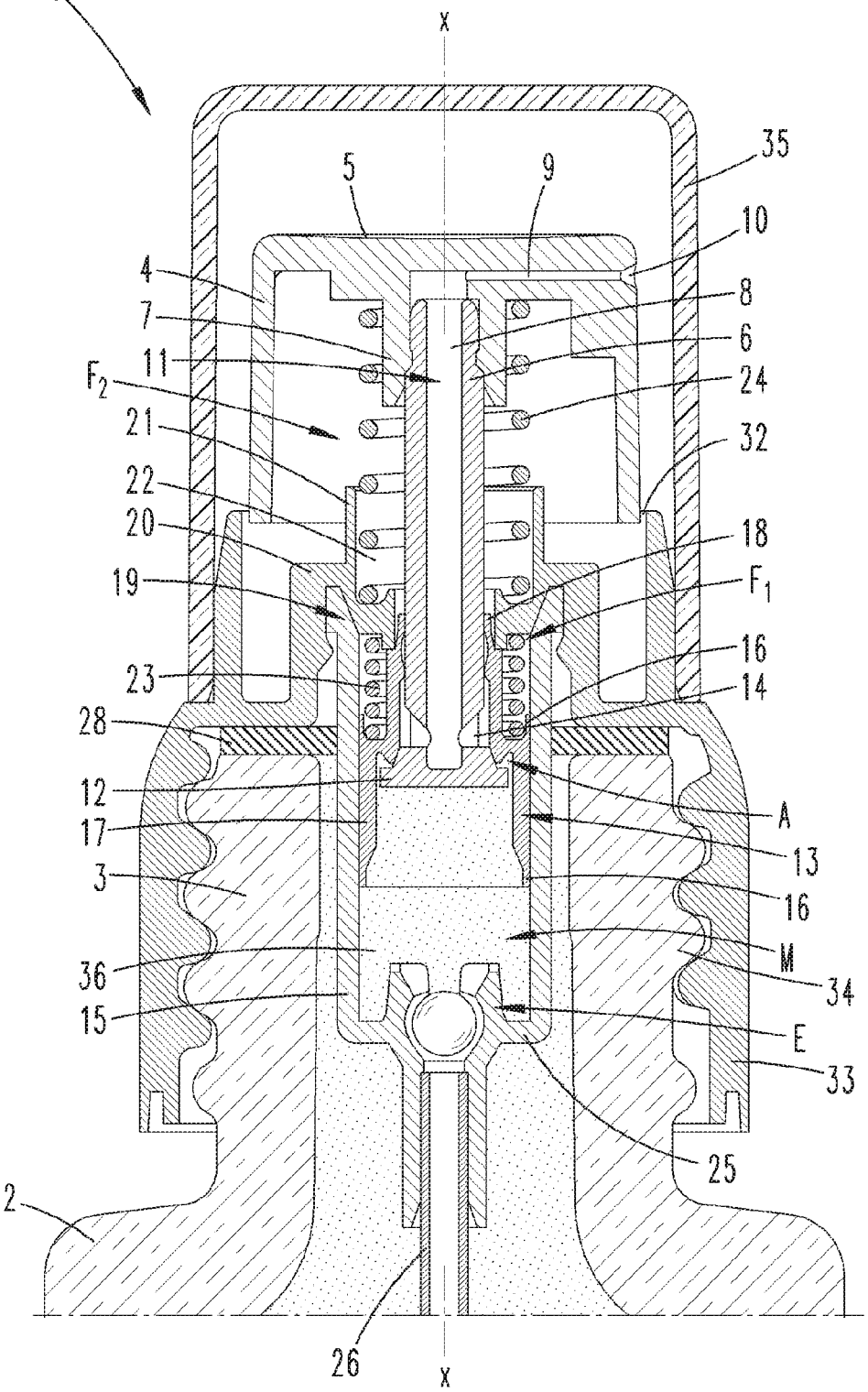
FIG. 10 shows the second embodiment with the finger spray pump configured for a screw connection with a container.

The FIGS. 6 to 8 and furthermore also the FIGS. 9 and 10 show a second embodiment of a finger spray pump 1, wherein the illustrations in the FIGS. 6 to 8 illustrate a crimp connection, which, for comparison, is released, as described with respect to the first embodiment.

The FIGS. 9 and 10 show securing solutions in the form of a snap-on connection and a screw connection. The solutions in this regard are comparable with the first embodiment as well.

In this embodiment, the piston rod 6 is in first instance secured in a rod holder 7, which, as viewed in the axial direction, is substantially shorter with respect to the first embodiment. The rod holder 7 extends only within the pump head 4.

The latching part 19 secured with the pump cylinder 15 forms a latching part bottom 37 which is oriented transverse to the body axis x. In the region of an opening, the latter is penetrated by the piston rod 6.

On the upper side of the latching part bottom 37, the second spring $F_2$ or, respectively, the pump head spring 24 is supported. On the lower side, the first spring F1 or, respectively, the piston spring 23 abuts against the latching part 19.

As in the first exemplary embodiment, the two springs $F_1$ and $F_2$ or the piston spring 23 and the pump head spring 24, respectively, are arranged axially one behind the other and outside of the medium path 11 so that hereby a slim, i.e. in particular a small-diameter design can be achieved. The medium M does not flow around the two springs.

In the second embodiment, in contrast to the first embodiment, the piston spring 23 or, respectively, the first spring $F_1$ is the spring with the lower spring constant with respect to the pump head spring 24 or, respectively, the second spring $F_2$.

When spraying the medium M, while pressing the pump head 4 down against the force of the stronger pump head spring 24, the pump piston 13, if applicable, is in first instance carried along via the weaker spring 23 so that the outlet valve A remains closed. Upon reaching a pressure in the pump chamber 36 which corresponds to the spring force of the weaker piston spring 23, the piston bottom 12, which is rigidly connected to the pump head 4, is further pressed down while the pump piston 13 remains in place relative thereto, resulting in opening of the outlet valve A. By further pressing the pump head 4 down, the medium M is expelled out of the pump chamber 36 through the open outlet valve A and the medium way 11.

The above embodiments serve for explanation of the invention comprised as a whole by the patent application, which refines the prior art in each case independently by the following feature combinations, namely:

A finger spray pump, which is characterized in that both springs ($F_1$ and $F_2$) are axially spaced apart from one another independent of the pump position.

A finger spray pump which is characterized in that the first spring $F_1$ has a greater spring constant than the second spring $F_2$ or vice versa.

A finger spray pump which is characterized in that the pump piston 13, in the actuated and/or non-actuated position, protrudes beyond the end region of the piston rod 6, which end region provides the outlet valve A.

A finger spray pump which is characterized in that the piston rod 6 has a central axial opening 8 for forming the medium path 11.

A finger spray pump which is characterized in that a latching part 19 is connected to the pump cylinder 15 at the upper side thereof, and that the latching part 19 is formed for supporting a pump head spring 24 which supports the pump head 4 relative to the pump cylinder 15.

A finger spray pump which is characterized in that a piston spring 23 acting between the piston rod 6 and the pump piston 13 is provided and that the piston spring 23 is at least partially accommodated in the latching part 19.

A finger spray pump which is characterized in that the piston spring 23 and the pump head spring 24 are supported on the latching part 19.

A finger spray pump which is characterized in that the latching part 19 forms a collar 21 which extends towards the pump head 4 and which leaves a circumferential space 22 to the piston rod 6, in which circumferential space the pump head spring 24 is accommodated.

A finger spray pump which is characterized in that the finger spray pump 1 is formed for a crimp connection with a container 2.

A finger spray pump which is characterized in that a crimp sleeve 27 is provided which encompasses the latching part 19 and the pump cylinder 15 at the same time in the region of at least the cooperation of the latching part 19 and the pump cylinder 15.

A finger spray pump which is characterized in that the finger spray pump 1 is formed for a snap-on connection with the container 2 and that elements 30 for engaging beneath a container neck 3 are formed on the latching part 19 which, at the same time, is formed for engaging over the container neck 3.

A finger spray pump which is characterized in that the latching part 19, in any case in the region of its portion associated with the container neck 3, is encompassed by a sleeve part 31.

A finger spray pump, which is characterized in that the sleeve part 31 is metallic.

A finger spray pump which is characterized in that the latching part 19 is formed with a screw cap 33 for forming a screw connection with the container neck 3.

All features disclosed are (in themselves, but also in combination with one another) pertinent to the invention. The disclosure content of the associated/accompanying priority documents (copy of the prior application) is also hereby included in full in the disclosure of the application, including for the purpose of incorporating features of these documents in claims of the present application. The subsidiary claims with their features characterize independent inventive refinements of the prior art, in particular to undertake divisional applications based on these claims.

REFERENCE LIST

1 Finger spray pump
2 Container
3 Container neck
4 Pump head
5 Actuation surface
6 Piston rod
7 Rod holder
8 Axial opening
9 Radial channel
10 Outlet nozzle
11 Medium path
12 Piston bottom
13 Pump piston
14 Radial opening
15 Pump cylinder
16 Sealing lip
17 Piston wall
18 Sealing lip
19 Latching part
20 Radial collar
21 Collar
22 Circumferential space
23 Piston spring
24 Pump head spring
25 Pump cylinder bottom
26 Suction tube
27 Crimp sleeve
28 Sealing washer
29 Cylinder portion
30 Element
31 Sleeve part
32 Opening
33 Screw cap
34 External thread
35 Cover cap
36 Pump chamber
37 Latching part bottom
A Outlet valve
E Inlet valve
$F_1$ First spring
$F_2$ Second spring
M Medium
x Body axis

The invention claimed is:

1. A finger spray pump (1) for spraying a medium (M), comprising a pump head (4), an outlet nozzle (11) and a pump chamber (36) having an inlet valve (E) and a pump piston (13), wherein the medium (M) passes through a medium path (11) between the pump chamber (36) and the outlet nozzle (10), wherein, furthermore, the pump piston (13) in cooperation with a piston rod (6) forms an outlet valve (A) and the pump piston (13) runs in a pump cylinder (15), wherein a latching part (19) is connected to the pump cylinder on the upper side thereof and wherein the latching part (19) is formed for supporting a pump head spring (24) which supports the pump head (4) relative to the pump cylinder (15), and further comprising a piston spring acting between the piston rod and the pump piston, the piston spring having a lower spring constant than a spring constant of the pump head spring, wherein the pump head spring and the piston spring are supported on the latching part in the actuated and non-actuated state of the spray pump, and wherein the pump head is configured such that during spraying, the pump head is displaced downward against a force of the pump head spring, which puts a load on the pump piston in a closed position of the outlet valve, and wherein upon reaching a pressure exceeding the spring force of the piston spring in the pump chamber, the piston rod is displaced relative to the pump piston, which opens the outlet valve.

2. The finger spray pump according to claim 1, wherein the piston spring (23) is at least partially accommodated in the latching part (19).

3. The finger spray pump according to claim 1, wherein the latching part (19) forms a collar (21) which extends towards the pump head (4) and which leaves a circumferential space (22) to the piston rod (6), in which circumferential space the pump head spring (24) is accommodated.

4. The finger spray pump according to claim 1, wherein the finger spray pump (1) is formed for a crimp connection with a container (2).

5. The finger spray pump according to claim 1, wherein a crimp sleeve (27) is provided which encompasses the latching part (19) and the pump cylinder (15) at the same time, at least in the region of at least the cooperation of the latching part (19) and the pump cylinder (15).

6. The finger spray pump according to claim 1, wherein the finger spray pump (1) is designed for a snap-on connection with a container (2) and wherein elements (30) for engaging beneath a container neck (3) are formed on the latching part (19) which, at the same time, is formed for engaging over the container neck (3).

7. The finger spray pump according to claim 6, wherein the latching part (19) is encompassed by a sleeve part (31), in a region of a portion associated with the container neck (3).

8. The finger spray pump according to claim 7, wherein the sleeve part (31) is metallic.

9. The finger spray pump according to claim 1, wherein the latching part (19) is formed with a screw cap (33) for forming a screw connection with a container neck (3).

* * * * *